US008146614B2

(12) United States Patent
Ford et al.

(10) Patent No.: US 8,146,614 B2
(45) Date of Patent: Apr. 3, 2012

(54) BEVERAGE HOLDER ATTACHMENT FOR CRUTCH

(76) Inventors: Donna Ford, Malibu, CA (US); Jack Ford, Malibu, CA (US)

( * ) Notice: Subject to any disclaimer, the term of this patent is extended or adjusted under 35 U.S.C. 154(b) by 80 days.

(21) Appl. No.: 12/692,633

(22) Filed: Apr. 12, 2010

(65) Prior Publication Data

US 2011/0247667 A1 Oct. 13, 2011

(51) Int. Cl.
*A61H 3/02* (2006.01)

(52) U.S. Cl. ..... 135/68; 135/66; 248/311.2; 224/407

(58) Field of Classification Search ..... 135/65–66, 135/68, 71–73; 248/210–211, 309.1, 311.2, 248/312.1, 230.6, 229.1; 182/116, 121; 224/407, 224/414, 420
See application file for complete search history.

(56) References Cited

U.S. PATENT DOCUMENTS 4,146,045 A * 3/1979 Grant ..... 135/66
4,289,156 A * 9/1981 Ulics ..... 135/66
4,878,642 A * 11/1989 Kirby, Jr. ..... 248/311.2
5,647,519 A * 7/1997 Brennan ..... 224/407
5,803,327 A * 9/1998 Nipper et al. ..... 224/407
5,806,817 A * 9/1998 Loud ..... 248/210
D411,654 S * 6/1999 Olkey et al. ..... D3/10
6,505,802 B2 * 1/2003 Fowler ..... 248/311.2
6,601,865 B1 * 8/2003 Harper ..... 280/304.1
2010/0051633 A1 * 3/2010 Porte et al. ..... 220/737

* cited by examiner

*Primary Examiner* — Winnie Yip
(74) *Attorney, Agent, or Firm* — Jeffrey L. Thompson; Thompson & Thompson, P.A.

(57) ABSTRACT

A beverage holder attachment for a crutch has an annular cup holder portion and two molded C-shaped protrusions for snapping onto two side rails of a crutch. The cup holder has a vertical slot on the outside to accommodate a handle of a mug or cup. The cup holder sits in between the two rails of the crutch below the hand bar so that it does not interfere with the use of the hand bar. The cup holder is tilted slightly to avoid spillage on the user of the crutches, so that any coffee drips will spill on the outside of the crutch. The beverage holder can be snapped onto the crutch side rails to carry beverages or other objects around the home or office while on crutches. The beverage holder can be made out of plastic, rubber or any other molded material that will snap onto the crutch.

7 Claims, 1 Drawing Sheet

BEVERAGE HOLDER ATTACHMENT FOR CRUTCH

BACKGROUND OF THE INVENTION

1. Field of the Invention

The present invention relates generally to attachments for crutches, and in particular to a beverage holder attachment for attaching to the side rails of a crutch.

2. Description of the Related Art

Crutches are known in the prior art. Crutches are often used to aid the mobility of a person with a temporary disability, such as a broken leg. A conventional crutch includes a pair of side rails with lower ends connected by a leg joint, upper ends connected by a load bearing portion, and a hand bar connected between the side rails between the upper and lower ends.

A crutch user typically positions the load bearing portion in the user's arm pit and grips the hand bar with the user's hand. Therefore, it is difficult for a crutch user to carry items, such as coffee cups or other beverages, because the user's hands are being used to grip the hand bar to use the crutch.

The present invention was conceived while one of inventors was on crutches for approximately four months and needed to have her coffee every morning and to carry coffee to the office and around home while on crutches. This was particularly difficult to accomplish without the use of hands, without relying on others to carry items for her, with minimal spillage, and without interfering with the use of the crutches or the crutch hand bar.

SUMMARY OF THE PRESENT INVENTION

The present invention is a beverage holder for a crutch. The holder is a molded structure comprising an annular cup holder portion and two C-shaped protrusions extending outwardly from opposite sides of the cup holder portion. The C-shaped protrusions are arranged to snap onto and off of the side rails of the crutch. The cup holder portion has an open top end and an open bottom end and a sidewall that tapers from a larger diameter at the top end to a relatively smaller diameter at the bottom end. The C-shaped protrusions each have an open side facing outwardly relative to the cup holder portion and are arranged to snap onto the side rails between the hand bar and the lower ends of the side rails to secure the cup holder portion to the crutch below the hand bar.

The beverage holder is a one piece molded structure, made out of plastic, rubber, or any other molded material, which snaps onto the crutch by the two C-shaped protrusions on each end of the holder. When attached, the holder is located between the two side rails of the crutch and does not interfere with the use of the crutch hand bar. The holder can be used to carry any coffee mug or cup with a handle, travel mugs, or any disposable coffee cup of any size, or other beverage containers or items while on crutches, without the use of hands to hold the beverage. The cup holder is tilted slightly to minimize spillage on the user of the crutches. The cup holder has a vertical slot feature on one side to accommodate the handle of a regular or travel coffee mug or cup so that the coffee mug fits securely into the holder without falling out of the holder.

DETAILED DESCRIPTION OF THE INVENTION

Figure 1:
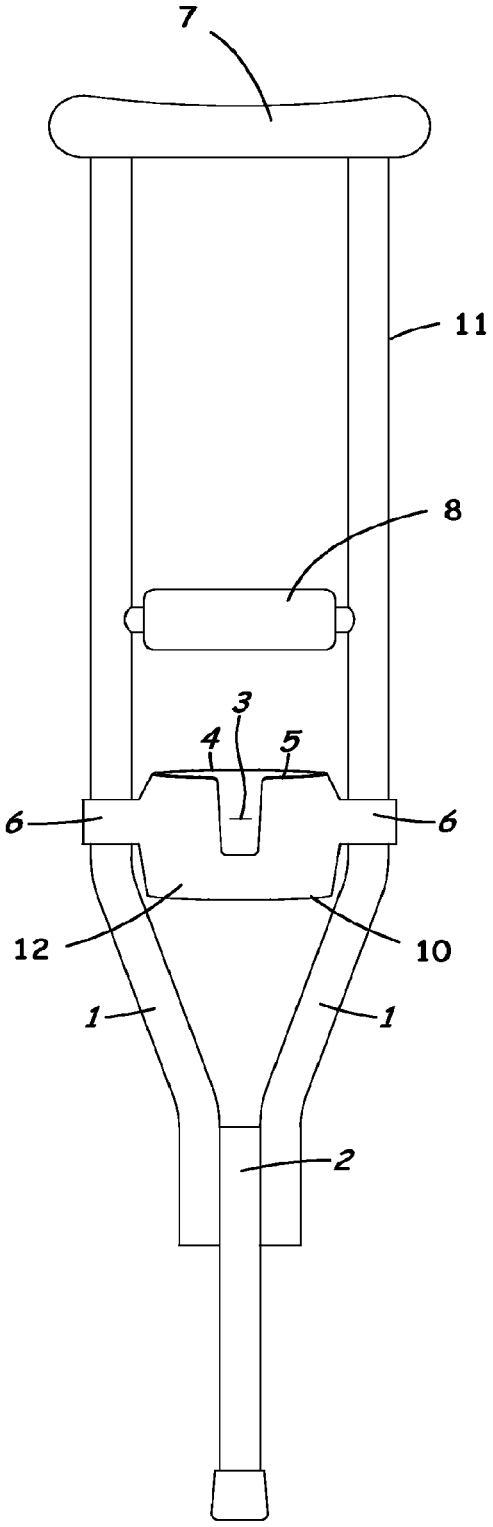
FIG. 1 is an elevation view of the outward facing side of the beverage holder of the present invention attached to a crutch.

The present invention provides a beverage holder attachment 10 for use with a conventional crutch 11. A conventional crutch 11 is illustrated together with the beverage holder attachment 10 in FIGS. 1 and 2. The crutch 11 includes a pair of side rails 1 with lower ends connected by a leg joint 2, upper ends connected by a load bearing portion 7, and a hand bar 8 connected between the side rails 1 between the upper and lower ends thereof.

The beverage holder attachment 10 is a molded structure comprising an annular cup holder portion 12 and two C-shaped protrusions 6 extending outwardly from opposite sides of the cup holder portion 12. The C-shaped protrusions 6 are arranged to snap onto and off of the side rails 1 of the crutch 11. The cup holder portion 12 has an open top end and an open bottom end and a sidewall that tapers from a larger diameter at the top end to a relatively smaller diameter at the bottom end. The C-shaped protrusions 6 each have an open side facing outwardly relative to the cup holder portion 12 and are arranged to snap onto the side rails 1 between the hand bar 8 and the lower ends of the side rails 1 to secure the beverage holder 10 to the crutch below the hand bar 8. The beverage holder 10 is snapped onto the crutch side rails 1 by the two C-shaped protrusions 6 so that the holder 10 sits in between the two side rails 1 of the crutch and does not interfere with the use of the crutch hand bar 8.

The cup holder portion 12 has a vertical slot 3 located on one side to accommodate a coffee mug or cup with a handle, a travel mug with a handle, or a disposable coffee cup.

The cup holder portion 12 is tilted slightly with an edge 4 closest to the crutch user being higher than an edge 5 farthest from the crutch user when the crutch 11 is vertical. The tilt helps avoid a beverage carried in the cup holder portion 12 from spilling onto the crutch user's clothes while transporting the beverage on crutches 11, so that any spilled coffee will spill from the side of the holder 10 located on the outside of the crutch 11.

The cup holder portion 12 and the C-shaped protrusions 6 comprise a single integral molded structure and can be made of plastic, rubber, or other molded material that allows the C-shaped protrusions 6 to snap onto the side rails 1.

Figure 2:
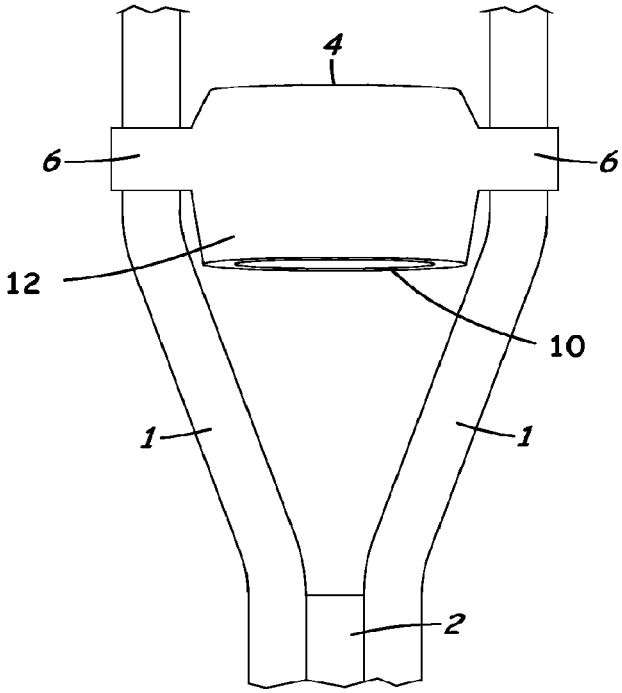
FIG. 2 is an elevation view of the inside facing side of the beverage holder of the present invention attached to a crutch.

As shown in FIGS. 1 and 2, the C-shaped protrusions 6 of the holder 10 are arranged so that the holder 10 can slide up and down the side rails 1 for adjusting a position of the beverage holder 10 on the crutch 11. The convergence of the side rails 1 near their bottom ends limits the extent of downward movement of the holder 10 along the side rails 1.

Figure 3:
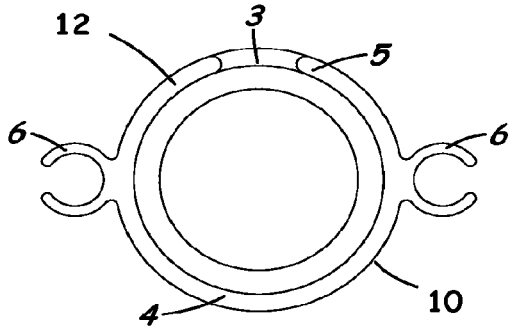
FIG. 3 is a plan view of the top of the beverage holder of the present invention.
Figure 4:
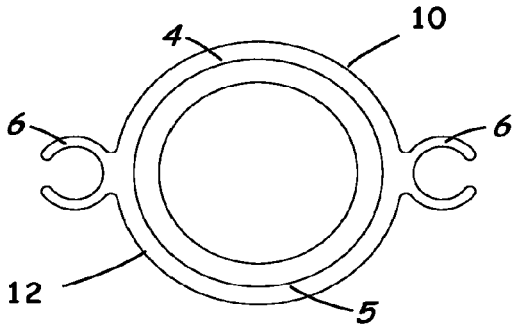
FIG. 4 is a plan view of the bottom of the beverage holder of the present invention.

As shown in FIGS. 3 and 4, the C-shaped protrusions 6 each have a C-shape that opens outwardly on respective opposite sides of the cup holder portion 12 when viewed in plan view. The C-shaped protrusions partially surround the side rails 1 to provide a snap fit that allows the holder 10 to be easily snapped on and off of the crutch 11.

A first prototype of the invention was made by using packing tape to attach a modified plastic cup holder from a child's car seat to a crutch. The prototype proved useful for carrying a mug or cup with a handle, a travel mug, and a disposable coffee cup of any size.

The illustrated embodiment is a simple "snap on" molded beverage holder 10 that will be particularly useful for coffee drinkers to use while on crutches for any period of time. The holder 10 can be easily snapped on and off, used on either or both crutches, and can be made out of plastic, rubber, or any other molded material that will snap onto the crutch.

The beverage holder attachment 10 can be used to carry coffee, beverages, and any number of other objects, around the home or office while on crutches, including a coffee mug or cup, a travel mug, disposable coffee cup, or any other type of bottle or beverage cup or container, or other small items and papers.

In one example embodiment, the annular cup holder portion 12 of the holder 10 measures approximately 3.25" in diameter at the top and approximately 2.75" in diameter at the bottom, and has a sidewall that tapers from the top to the bottom. The cup holder portion 12 is approximately 2.25" in height, and the vertical slot 3 is approximately 1.5" deep, 1" wide at the top, and 0.75" wide at the bottom. The vertical slot 3 is located on one side to accommodate the handle of a coffee mug or a travel mug (see FIG. 1). The cup holder portion 12 is slightly tilted with the outward edge 5 approximately 0.25" lower than the inside edge 4 to prevent any small amount of spilled coffee from getting on the clothes of the crutch user during transit. The two molded C-shaped protrusions 6 on both sides of the holder 10 are approximately 0.75" in height and 0.75" in diameter. The C-shaped protrusions 6 are arranged to snap onto the two side rails 1 of the crutch 11 (see FIGS. 3, 4) just above the convergence near the bottom ends of the side rails 1, approximately 4' above the crutch joint 2 and approximately 7" below the crutch hand grip 8 at its highest level, and varying heights when the hand grip 8 is adjusted or set lower.

Any variety of other items can be carried in the beverage holder 10 in addition to coffee mugs or cups, including canned drinks, Styrofoam or plastic beverage holders, bottled beverages, water bottles or rolled or folded papers from trips to the mailbox or around the home or office, cell phones, or other electronic hand held devices.

We claim:

1. In combination with a crutch having a pair of side rails with lower ends connected by a leg joint, upper ends connected by a load bearing portion, and a hand bar connected between the side rails between the upper and lower ends, a beverage holder comprising:

a single integral molded structure comprising an annular cup holder portion and two C-shaped protrusions extending outwardly from opposite sides of said cup holder portion, said C-shaped protrusions being arranged to snap onto and off of said side rails;

said cup holder portion having an open top end and an open bottom end and a sidewall that extends between said top and bottom ends;

said C-shaped protrusions each having an open side facing outwardly relative to said cup holder portion and being arranged to snap onto said side rails between said hand bar and said lower ends of said side rails to secure said cup holder portion to said crutch below said hand bar and said cup holder portion having a vertical slot located on the sidewall to accommodate a handle of a cup.

2. The combination set forth in claim 1, wherein said sidewall of said cup holder portion tapers from a larger diameter at said top end to a relatively smaller diameter at said bottom end.

3. The combination set forth in claim 1, wherein said cup holder portion is tilted with an edge closest to a crutch user being higher than an edge farthest from the crutch user when the crutch is vertical to help prevent a beverage carried in said cup holder portion from spilling onto the crutch user during transit.

4. The combination set forth in claim 1, wherein said C-shaped protrusions are arranged to slide up and down said side rails for adjusting a vertical position of said beverage holder on said crutch.

5. The combination set forth in claim 1, wherein said C-shaped protrusions each have the open side that opens outwardly on respective opposite sides of said cup holder portion when viewed in plan view.

6. The combination set forth in claim 1, wherein said C-shaped protrusions partially surround said side rails to provide a snap fit that allows the holder to be easily snapped on and off of said crutch.

7. The combination set forth in claim 1, wherein said holder comprises plastic, rubber, or other molded material that allows said C-shaped protrusions to snap onto said side rails.

* * * * *